United States Patent [19]

Hickman

[11] 4,119,192

[45] Oct. 10, 1978

[54] MULTIPLE COIN MECHANISM FOR NEWSRACK

[76] Inventor: Paul G. Hickman, Rte. 4, Box 127A, Covington, Ga. 30209

[21] Appl. No.: 756,198

[22] Filed: Jan. 3, 1977

[51] Int. Cl.[2] ..... G07F 5/06; G07F 17/04

[52] U.S. Cl. ..... 194/59; 194/DIG. 2

[58] Field of Search ..... 194/1 G, 55, 58, 59, 194/DIG. 2

[56] References Cited

U.S. PATENT DOCUMENTS

| | | | |
|---|---|---|---|
| 1,656,752 | 1/1928 | Naunton | 194/58 |
| 1,812,232 | 6/1931 | Berland | 194/DIG. 2 |
| 2,603,334 | 7/1952 | Curren | 194/59 |
| 2,777,554 | 1/1957 | Steiner | 194/DIG. 2 |
| 3,732,962 | 5/1973 | Hall | 194/92 |

FOREIGN PATENT DOCUMENTS

| | | | |
|---|---|---|---|
| 1,292,915 | 4/1969 | Fed. Rep. of Germany | 194/1 G |

*Primary Examiner*—Robert B. Reeves
*Assistant Examiner*—Francis J. Bartuska
*Attorney, Agent, or Firm*—Newton, Hopkins & Ormsby

[57] ABSTRACT

A completely mechanical coin mechanism for newspaper dispensing racks and the like embodies a coin slide which is activated by a door operated lever when proper coins are utilized, movement of the slide being positively blocked by a system of overhead gravity biased pawls when improper or faulty coins are used so that the rack door cannot be pulled open. The system of pawls can detect in all cases whether a proper or improper combination of coins has been inserted in the mechanism by a customer. The entire mechanism is characterized by simplicity and ruggedness of construction as well as reliability of operation.

10 Claims, 9 Drawing Figures

MULTIPLE COIN MECHANISM FOR NEWSRACK

BACKGROUND OF THE INVENTION

Numerous types of coin mechanisms for dispensing machines and the like are known in the prior art. Some such coin mechanisms are mechanical in nature while others are electrically operated in whole or in part. Some mechanisms employ springs to bias operating components. Generally speaking, the prior art coin mechanisms tend to be delicate and are subject to various forms of malfunction, requiring frequent and costly servicing to keep them in operating order.

Some examples of the patented prior art shown in prior U.S. Pat. Nos. 1,761,784; 1,900,074; 2,116,309; 2,256,486; 3,602,352 and 3,712,440. Newspaper dispensing racks are subjected to unusually rough treatment and abuse by users and present a particular problem in terms of the coin mechanisms which they employ. For satisfactory and trouble-free operation, the coin mechanisms on newsracks must be extremely sturdy and durable, and they should be simplified in construction and operation and require little or no adjustment for efficient performance. They should be all mechanical inasmuch as newsracks are frequently placed outdoors where electrical connections are not readily available. Generally speaking, the prior art has not provided entirely satisfactory coin mechanisms of this type and there is a need for a better mechanism in terms of reduced cost of manufacturing and maintenance and the other factors above-mentioned. The present invention seeks to satisfy this need of the art by provision of a coin mechanism which is ideally suited to newsrack applications or similar applications where simplicity and ruggedness are paramount.

SUMMARY OF THE INVENTION

The invention provides an all-mechanical simplified and very rugged coin mechanism which is mounted as a unit on a newsrack for cooperation with a door mounted hook assembly having mechanism activating and resetting elements or hooks. A simplified coin slide means under control of the door operated hook assembly is mounted on a common sturdy base with an overhead system of gravity biased pawls which can positively lock the slide means against activation when an improper combination of coins or defective coins are inserted. Means are provided on the unitized mechanism assembly to lock out or disable groups of the pawls selectively, such as the pawls which detect the proper coins for daily or Sunday newspapers. The use of springs, fine adjustments and small delicate parts is avoided in the mechanism.

DETAILED DESCRIPTION

Figure 1:
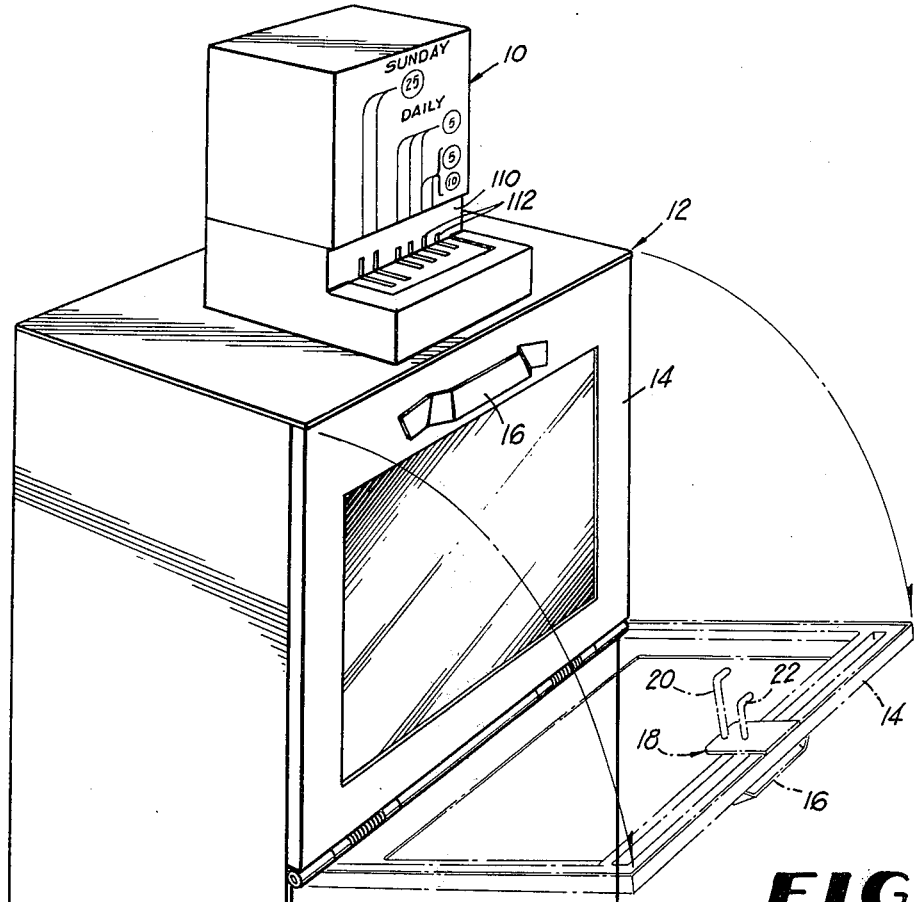
FIG. 1 is a perspective view of a newsrack equipped with the coin mechanism according to the invention.

Referring to the drawings in detail wherein like numerals designate like parts, a coin mechanism 30 and its housing 10 are secured to the top of a newsrack 12 having a hinged access door 14 provided with a handle 16 for use by a customer in pulling the door to an open position as shown in phantom lines in FIG. 1 so that a newspaper may be removed from the rack following the insertion of proper coins into the coin mechanism. The access door 14 carries a hook assembly 18 on its inner side opposite the handle 16 and the hook assembly has a first hook 20 which cooperates with a crank arm or lever 24 when the door is pulled open to advance the coin slide, as will be fully described. The hook assembly includes a second hook 22 which cooperates with the same crank arm 24 when the door 14 is closed by the customer to retract the coin slide and reset the mechanism.

Figure 2:
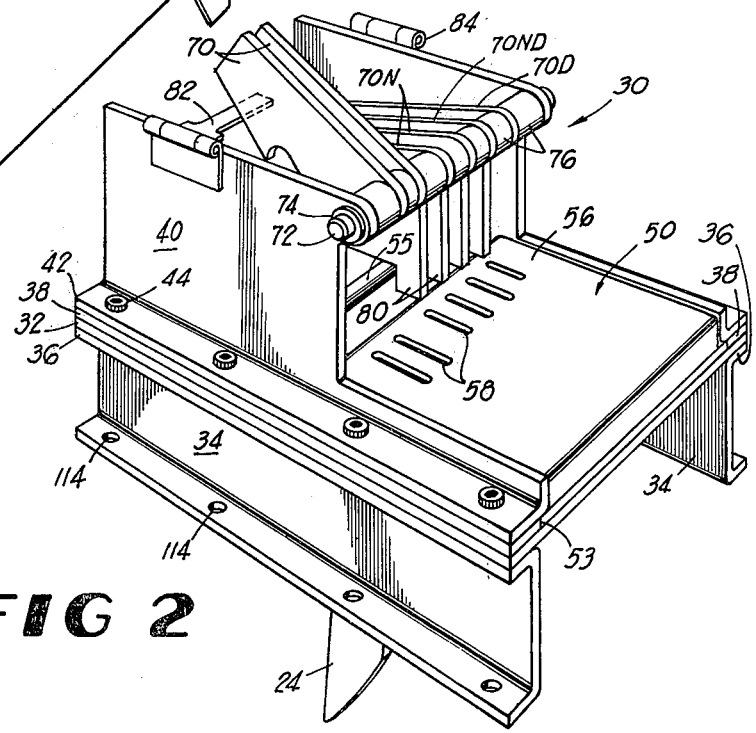
FIG. 2 is a perspective view of the coin mechanism with its housing removed and shown separated from the newsrack.
Figure 3:
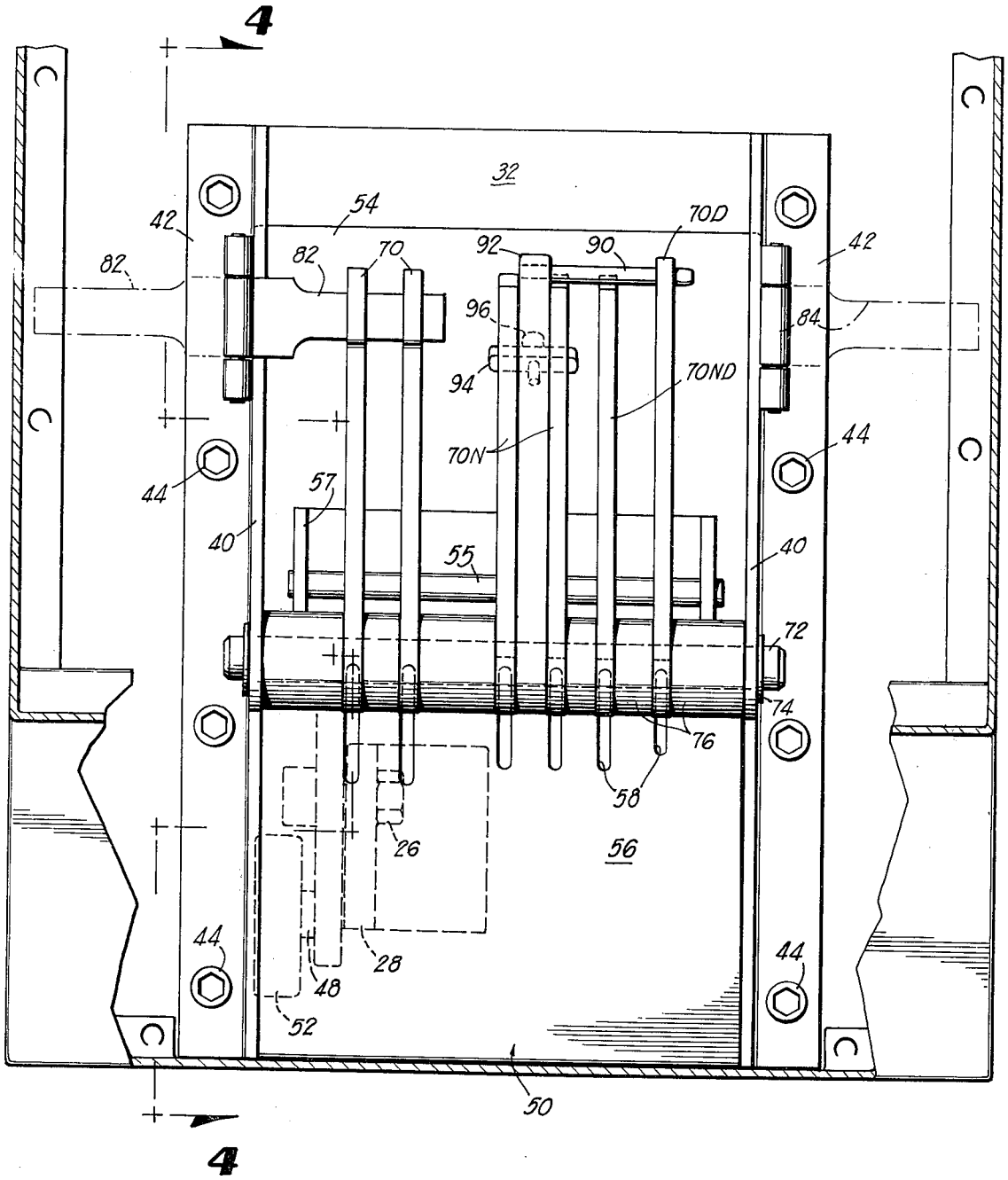
FIG. 3 is a plan view of the coin mechanism, partly in cross section.
Figure 4:
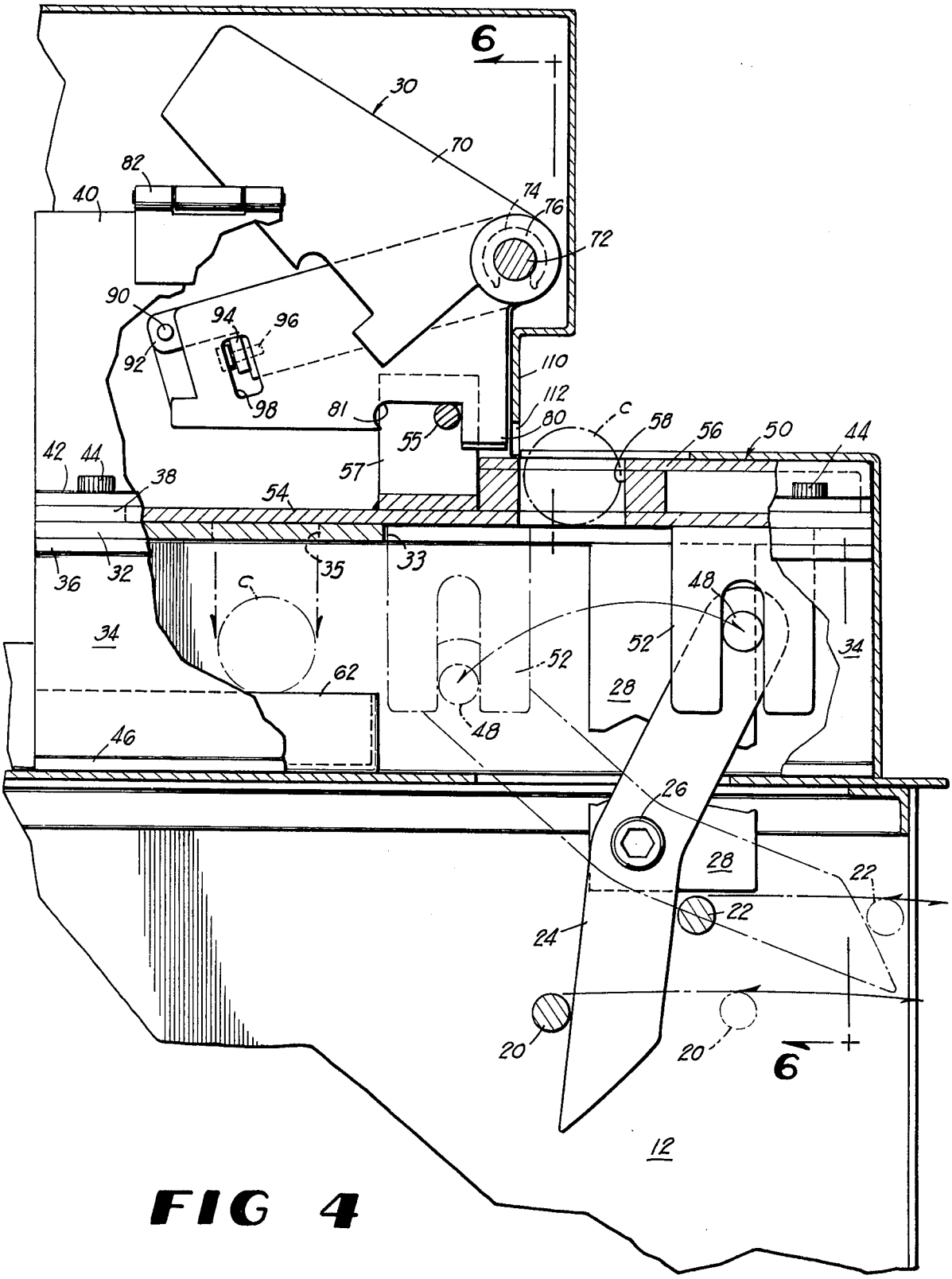
FIG. 4 is a fragmentary vertical section taken on line 4—4 of FIG. 3.
Figure 5:
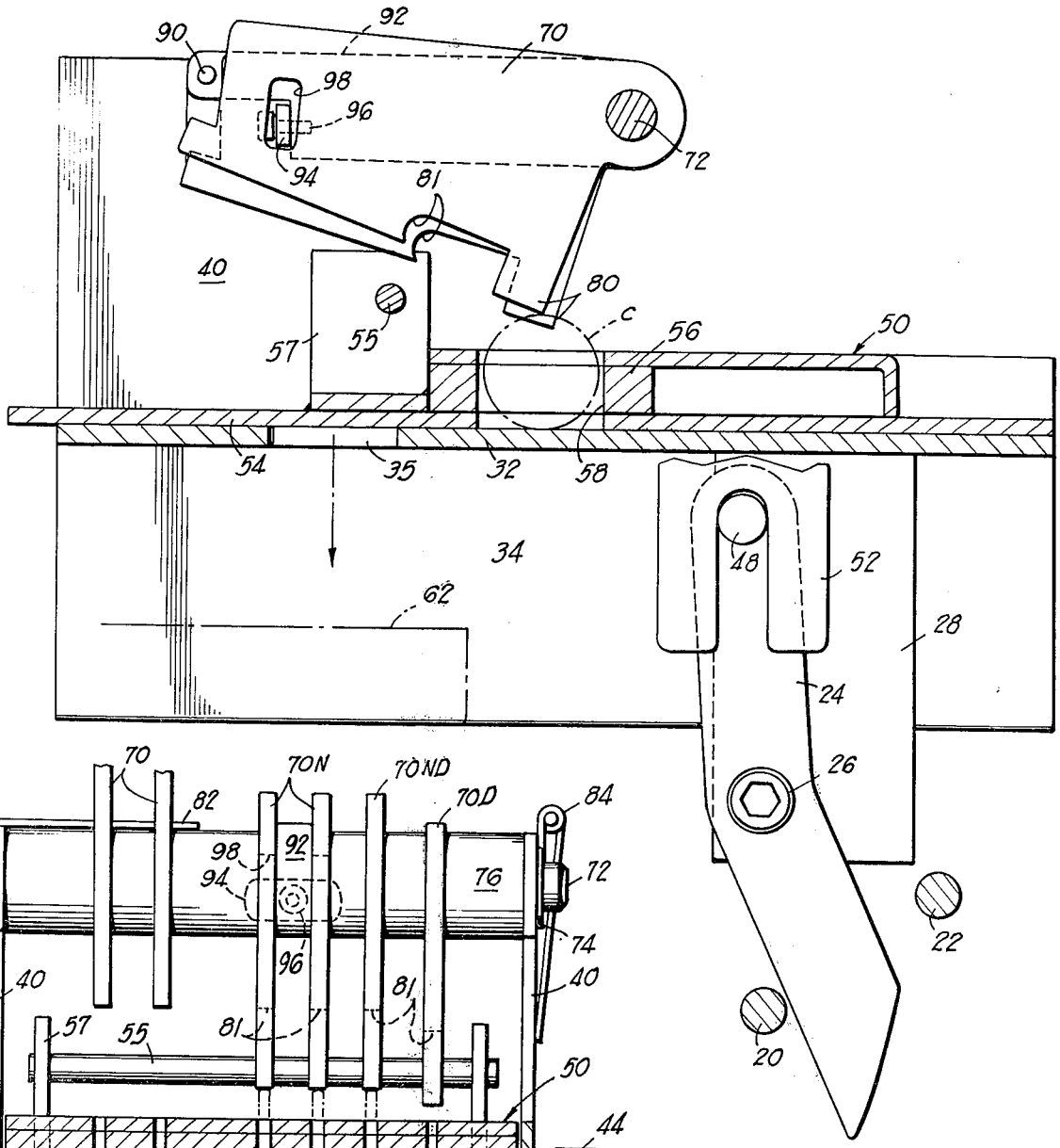
FIG. 5 is a cross sectional view similar to FIG. 4 showing the coin slide and its operating lever in an advanced position with particular coin detection pawls raised on their pivots to free the slide for full inward movement and coin deposit.

The crank arm 24 of coin mechanism 30 is shown clearly in FIGS. 4 and 5 in relation to the two coacting hooks 20 and 22. The crank arm 24 is attached to the coin mechanism 30 through a horizontal axis pivot bolt 26 fixed to a pivot bolt bracket 28, in turn fixed to a coin mechanism base plate 32, FIG. 6. The coin mechanism 30, which consists of a unit assembly as depicted in FIG. 2, has a pair of lower side rails 34 which have upper flanges 36 thereon, and these flanges are directly under the base plate 32 of the coin mechanism to support the base plate. The two rails 34 are rigidly interconnected through the horizontal base plate 32.

Atop the base plate 32 and overlying the flanges 36 are narrow spacer plates 38 which are parallel. Resting on the spacer plates 38 are lower flanges 42 of upper side walls 40. The flanges 40, spacer plates 38, base plate 32 and the flanges 36 are secured rigidly by screws 44.

A coin slide designated by the numeral 50 includes a carriage or slide plate 54 of slightly less thickness than the spacer plates 38 and operating slidably between the spacer plates in a guideway 53 formed between the spacer plates 38 and immediately above the base plate 32. The carriage plate 54 is thus slidably mounted on the fixed base plate 32 for fore and aft guided reciprocation, and is restrained against upward movement by the flanges 42, FIG. 6.

Fixed to the bottom of the carriage plate 54 is a bifurcated yoke 52 which transmits horizontal reciprocation to the coin slide assembly 50 from the crank arm 24 through a crank arm lug 48.

The slide assembly 50 further includes a coin block 56 immediately above and attached to carriage plate 54 and having coin slots 58 formed therethrough. As shown in FIG. 5, the coin slots 58 also extend through the horizontal carriage plate 54 which rides on the base plate 32. The base plate has coin slots 35 near the rear end thereof, FIGS. 4 and 5, and immediately above a coin receiving tray 62 in the bottom of the coin mechanism.

As shown in FIGS. 4 and 5, the two door carried hooks 20 and 22 are disposed rearwardly and forwardly of the crank arm 24, respectively. Thus, when the door 14 is pulled open, the hook 20 turns the crank arm from the solid line position in FIG. 4 counterclockwise toward the broken line position and as a result the coin slide 50 is shifted horizontally to the rear of the apparatus. The coins C which are engaged in the slots 58 of the coin slide will now be carried to the rear of the base plate 32 and when they register with the slots 35, the coins will be deposited in the tray 62. It might be noted at this time that the coin slide yoke 52 operated through a clearance slot 33 provided for it in the base plate 32.

When the door 14 is returned to the closed position following removal of a newspaper, the hook 22 moving with the door engages the forward side of the crank arm 24 below its pivot 26 and returns the coin slide 50 and associated parts to the forward position shown in FIG. 4. It can be seen that the support structure, guidance means and the door activated operating means for the coin slide 50 is of a simple, compact and extremely sturdy nature, and the structure is unitized.

The coin mechanism 30 additionally comprises two groups of gravity biased overhead pivoted pawls above the slide guidance and support means and cooperating therewith in a unique manner, to be fully described. The pawls are in two groups, the first of which groups consists of two pawls 70 and the second group consists of four pawls. In the second group of four pawls, one adjacent pair are designated 70N (nickel pawls), the next pawl is designated 70ND (nickel-dime), and the fourth pawl in the second group is designated 70D (dime). All of these pawls in the two groups are pivotally mounted at their forward ends on a common horizontal transverse pivot axle or shaft 72 supported considerably above the slide assembly 50 near the tops of the upper side walls 40 and near their forward ends, FIG. 2. Thus, the shaft 72 is almost directly above the coin slots 58. The shaft 72 is retained on the side walls 40 by retainer clips 74 or equivalent means.

It should be noted that the two pawls 70 in the first group are provided to detect the presence or absence of 2 quarters, the customary price of a Sunday newspaper. The four pawls in the second group are to detect combinations of nickels and dimes which total 15 cents, the usual price of a daily newspaper.

A feature of the mechanism is the provision of a pair of hinged arms 82 and 84 carried by the tops of the side walls 40 rearwardly of the coin detecting pawls. The arm 82 can be swung to a horizontal position, FIG. 2, beneath the two "quarter" pawls 70 to elevate these pawls and thereby render the mechanism inoperable for the sale of Sunday papers. Similarly, the arms 84 can be moved beneath the four pawls of the second group to disable the mechanism for the sale of daily papers, if desired. The several pawls pivoted on the common shaft 72 are maintained in proper alignment with the coin slots 58 of coin slide 50 by spacers 76 on the common pivot shaft.

As shown in FIGS. 4 and 5, each coin detection pawl of the apparatus has a depending tang 80 at its forward end which is engaged and lifted by a coin C in a slot 58 during rearward travel of the coin slide 50. Rearwardly of this tang 80, each pawl has a notch 81 which can lock behind a transverse horizontal bar 55 secured to the carriage plate 54 through a U-shaped bracket 57. Thus, the bar 55 moves with the coin slide. If a coin C is absent, or of insufficient diameter to elevate a particular pawl of the apparatus, the hook-like notch 81 will engage the rear side of the bar 55 and prevent further rearward movement of the entire coin slot. At this time, the customer will be unable to open the door 14 except for a very small amount and can return the door to the closed position and try again with proper coins. It can be noted that the coin detecting means is very simple, positive and does not depend on springs or require fine adjustments. The detection pawls are biased down by gravity.

When purchasing a Sunday newspaper for a customary 50 cents, the daily newspaper pawls 70N, 70ND and 70D will be disabled by the arm 84, as previously described, and the two pawls 70 which detect quarters will be in their normal down active positions. If 2 quarters are inserted in the quarter slots 58 of the coin slide 50, the customer will be able to open the door 14 and take a paper while the quarters are being deposited in the coin tray 62. If one quarter should be absent or of an insufficient diameter, the mechanism will simply return the coins with the slide 50 to the original position enabling the customer to use proper coins in the mechanism.

The operation of the daily newspaper pawls or the 15 cent group of pawls can be understood in connection with FIGS. 3 and 6 through 9. At this time, the coin mechanism 30 must detect either 3 nickels, or 1 dime and 1 nickel, each combination totaling 15 cents. This is accomplished by use of a bale pin 90 transverse to the pawls and forming a rigid connection from the pawl 70D which overlies the dime slot 58 to a bale pin arm 92 holding the pin 90 which is pivotally connected to the common pawl pivot shaft 72. As clearly shown in FIG. 3, the arm 92 is straddled by the two pawls 70N. The bale pin arm 92 carries a pivot lever element 94 pivoted to the arm 92 at its center by a bolt 96. The pivoted lever element 94 has its opposite ends projecting through slots 98 in the adjacent straddling pawls 70N.

Figure 6:
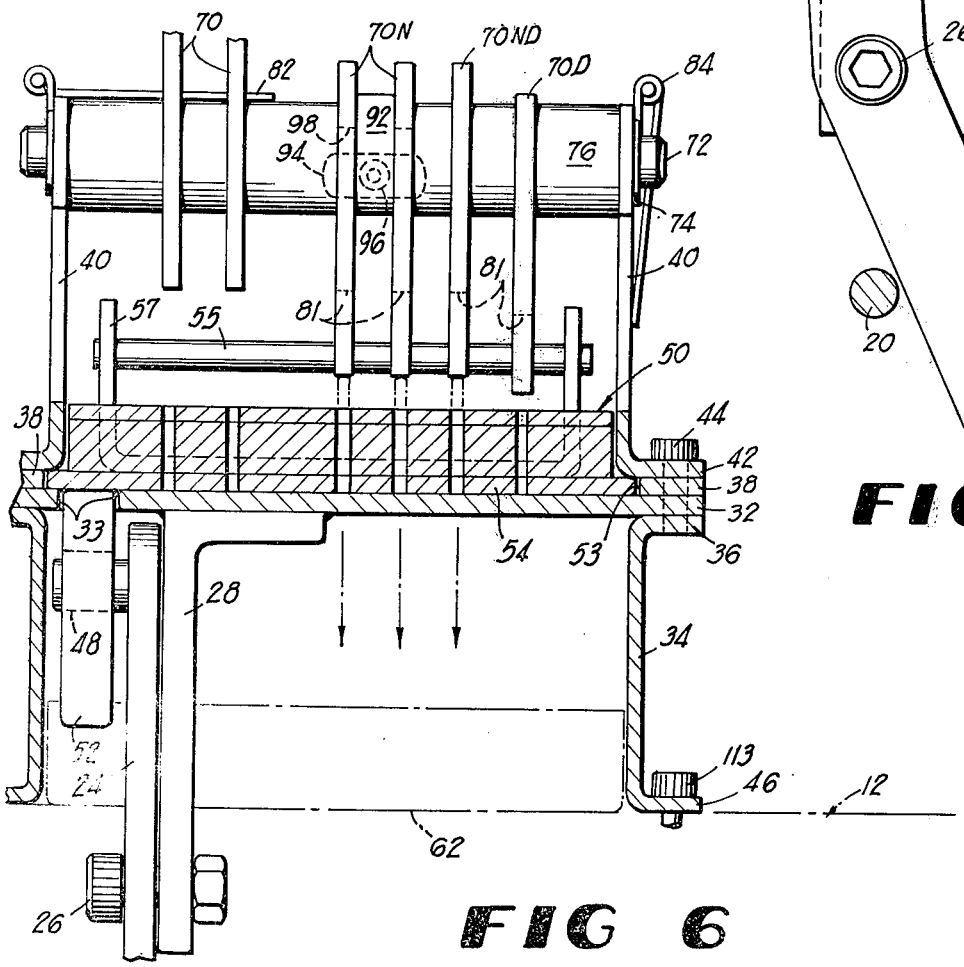
FIG. 6 is a transverse vertical section taken substantially on line 6—6 of FIG. 4.

As can be seen in FIGS. 5 and 6, when 3 nickels are used to purchase a daily paper, the element 94 is raised by engagement with the bottoms of slots 98 in the pawls 70N, thereby also raising the bale pin arm 92. This, in turn, lifts the dime pawl 70D by virtue of the bale pin 90 and its connection through the arm 92 to the pawl 70D. Therefore, when employing 3 nickels for the purchase of a daily paper, the dime pawl 70D will be raised automatically to allow the slide 50 to travel rearwardly.

Figure 7:
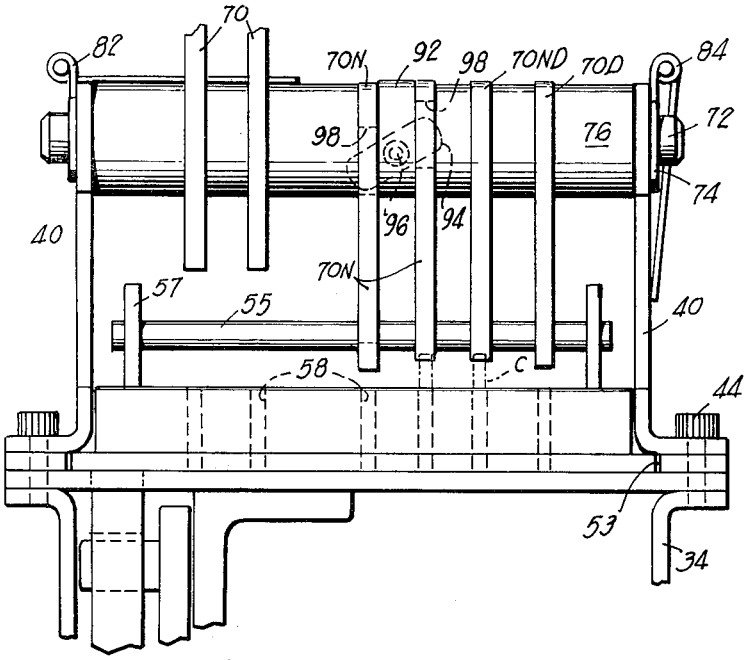
FIGS. 7, 8 and 9 are fragmentary elevational views of the pivoted coin detection pawls and associated parts generally as shown in FIG. 6 and depicting the operation of the mechanism in response to the insertion of various combinations of coins which represent the total amount necessary to purchase a daily newspaper.
Figure 8:
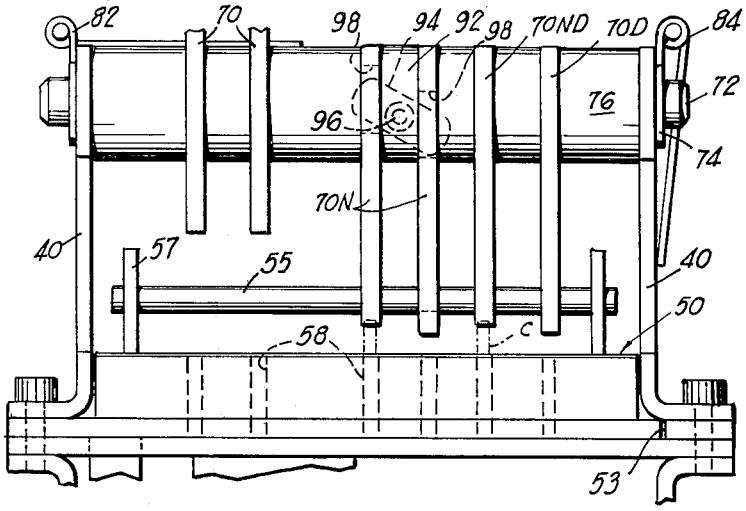
Figure 9:
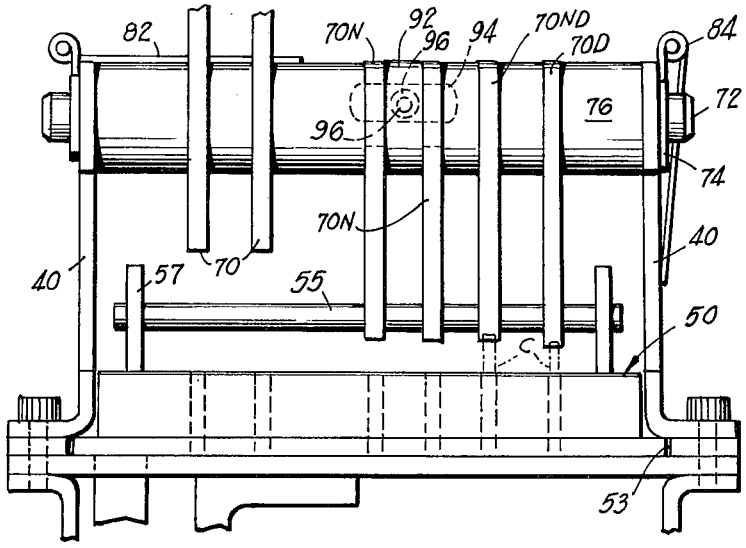

As can be seen in FIG. 7, if any one of the 3 nickels is not present or is of insufficient diameter, the two pawls 70N can detect independently the presence of a proper coin by virtue of the length of the slot 98 that the pivot lever element 94 may move in with lost motion in relation to the other pawl 70N. The pawl 70ND is a pawl that will always be used in the purchase of a daily paper either with a nickel that urges it up along with a dime or two more nickels under pawls 70N. When a dime is used, with the pawl 70D overlying it, the bale pin connection 90 will raise the pivot lever element 94 to the tops of slots 98 in pawls 70N, thereby clearing the notches 81 from the bar 55 of the coin slot assembly 50 and allowing the coin slide to move freely rearwardly notwithstanding empty coin slots 58 beneath the pawls 70N.

The above pawl mechanism is very sturdy, positive and economical in construction and requires no springs or complex adjustments. In addition to detecting coin diameters, by the pawl means above-described, a further detection means is embodied in the mechanism in terms of a face plate 110 on the housing of the coin mechanism 30, which vertical face plate is slotted at 112 to allow a particular coin to pass through such slot and engage the tang 80 of a pawl. The slots 112 are dimensioned in their heights to block any coin whose height is too great for a particular slot and thereby preventing such coins from entering the mechanism.

The unitized mechanism 30 is anchored to the top of the newsrack 12 by bolts 113, FIG. 6, which engage through apertures 114 in the lower flanges 46 of the rails 34. The coin mechanism is fitted with the housing 10 of sheet metal, having a lockable access door to allow a vendor to change over the mechanism from 15 cent operation to 50 cent operation, and to also remove coins from the depository tray 62 periodically.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A newsrack having a front access door, a coin mechanism and coin mechanism activating and reset elements on the interior of said door, said coin mechanism comprising support and front-to-back guideway means secured to said newsrack, a coin slide having slots for coins of different denominations to fall therethrough engaged with said support and front-to-back guideway means, a pivoted crank arm on said support and front-to-back guideway means and drivingly connected with the coin slide to shift the coin slide rearwardly toward a coin depositing position and forwardly toward a coin mechanism reset position respectively in response to opening and closing of said front access door, said activating and reset elements on said door disposed rearwardly and forwardly of said pivoted crank arm to turn the same in opposite directions on its pivot, a plurality of gravity biased pawls positioned above the coin slide, a common transverse axis pivot shaft for said pawls secured to said support and front-to-back guideway means, each pawl having a forward end depending tang in the path of movement of a coin in one slot of said coin slide and also having a notch in its lower edge rearwardly of said tang, a rigid pin element on the coin slide extending transversely of said pawls and engaging said notches lockingly to limit movement of the coin slide rearwardly toward said coin depositing position when said tangs are not engaged and elevated by coins of proper diameters moving with the coin slide, said pawls swinging upwardly on said common pivot shaft in response to engagement of the tangs by coins of proper diameters moving rearwardly with the coin slide to clear said notches from engagement with said rigid pin element and allowing the coin slide to travel rearwardly to said coin depositing position.

2. A newsrack as defined in claim 1, and said tang of each pawl comprising a substantially square tang and said notch rearwardly of the tang being a curved hook-like notch whose upper edge is joined to the rear of the tang by a straight edge portion forming a recess in the bottom of the pawl between the notch and tang, said rigid pin element comprising a cylindrical pin riding in said recess between the tang and notch and adapted to have its rearward side lockingly engaged by the notch during movement of the coin slide toward said coin depositiong position.

3. A newsrack as defined in claim 1, and said mechanism being a unitized assembly with said support and front-to-back guideway means, said means comprising a pair of spaced lower rails, a coin slide base plate mounted on and secured to the tops of said rails, spacer plates mounted on opposite side portions of said base plate, said coin slide mounted on said base plate between said spacer plates, a pair of upper side walls above said rails and mounted on and secured to said spacer plates and engaging above portions of the coin slide to prevent upward displacement thereof, and said common pivot shaft for said pawls extending between and mounted on said upper side walls.

4. A newsrack as defined in claim 1, and said gravity biased pawls arranged in two operating groups on said common pivot shaft, and manual means carried by said support and guideway means and being movable into lifting positions relative to said pawl groups so that each group selectively can be disabled by said manual means.

5. A coin mechanism for a newsrack having an access door and coin mechanism activating and reset elements on the door, said mechanism comprising support and guideway means adapted to be secured to a newsrack, a coin slide having slots for coins of different denominations engaged with the support and guideway means, a pivoted crank arm on the support and guideway means and drivingly connected with the coin slide to shift the coin slide toward a coin depositing position and a coin mechanism reset position respectively in response to opening and closing of the newsrack door, said activating and reset elements on the door disposed on opposite sides of said pivoted crank arm to drive the same, a plurality of gravity biased pawls positioned above the coin slide, a common pivot shaft for said pawls secured to said support and guideway means, each pawl having a depending tang in the path of movement of a coin in one slot of the coin slide and also having a notch in its lower side rearwardly of said tang, a rigid element on the coin slide extending transversely of said pawls and engaging said notches lockingly to linit movement of the coin slide toward said coin depositing position when said tangs are not engaged and elevated by coins of proper diameters moving with the coin slide, said pawls swinging upwardly responsive to engagement of said tangs by coins of proper diameters moving with the coin slide to clear said notches from engagement with said rigid element and allowing the coin slide to travel to said coin depositing position, said gravity biased pawls being arranged in two operating groups on said common pivot shaft, manual means carried by said support and guideway means and being movable into lifting positions relative to said pawl groups so that each group selectively can be disabled by said manual means, and said manual means comprising a pair of hinged arms on said support and guideway means near the elevations of said pawls and swingable between pawl disabling and pawl freeing positions.

6. A coin mechanism for a newsrack having an access door and coin mechanism activating and reset elements on the door, said mechanism comprising support and guideway means adapted to be secured to a newsrack, a coin slide having slots for coins of different denominations engaged with the support and guideway means, a pivoted crank arm on the support and guideway means and drivingly connected with the coin slide to shift the coin slide toward a coin depositing position and a coin mechanism reset position respectively in response to opening and closing of the newsrack door, said activating and reset elements on the door disposed on opposite sides of said pivoted crank arm to drive the same, a plurality of gravity biased pawls positioned above the coin slide, a common pivot shaft for said pawls secured to said support and guideway means, each pawl having a depending tang in the path of movement of a coin in one slot of the coin slide and also having a notch in its lower side rearwardly of said tang, a rigid element on the coin slide extending transversely of said pawls and engaging said notches lockingly to limit movement of the coin slide toward said coin depositing position when said tangs are not engaged and elevated by coins of proper diameters moving with the coin slide, said pawls swinging upwardly responsive to engagement of said tangs by coins of proper diameters moving with the coin slide to clear said notches from engagement with said rigid element and allowing the coin slide to travel to said coin depositing position, said gravity biased pawls on said common pivot shaft being arranged in two groups, one pawl group coacting with at least one coin of one denomination moving with said slide, and the pawls of the second group coacting with combinations of coins of two denominations moving with said slide, an arm mounted on said common pivot shaft between one pair of pawls in the second group for coins of one denomination, a transverse pin element carried by said arm and projecting therefrom toward another pawl in said second group away from said arm for a coin of another denomination, and a lost motion connection means between said arm and the pair of pawls between which said arm is arranged, whereby raising of the last-named pawls by coins of one denomination will also raise said pawl away from said arm by means of said pin element.

7. A coin mechanism for a newsrack as defined in claim 6, and said lost motion connection means comprising a pivoted lever element on said arm projecting beyond opposite sides of the arm and having its end portions recieved within lost motion slots in said pair of pawls between which said arm is arranged.

8. A coin mechanism for a newsrack as defined in claim 7, and a center pivot element for said pivoted lever element freely pivotally supporting the lever element adjacent an end face of said arm and spaced forwardly of said transverse pin element in relation to the line of movement of said slide.

9. A coin mechanism for a newsrack as defined in claim 6, and said lost motion connection between said arm and pair of pawls including slots formed through said pawls, and a transverse freely pivoted element on said arm having opposite end portions projecting into said slots whereby the pawls of said pair having said slots are able to rise and fall independently of each other responsive to engagement of coins with their tangs.

10. A coin mechanism for a newsrack as defined in claim 6, and another pawl in the second group of pawls between said pair and the pawl away from said arm for coins of the same denomination as those with which said pair of pawls coact.

* * * * *